US008492667B2

(12) United States Patent
Stelter

(10) Patent No.: US 8,492,667 B2
(45) Date of Patent: Jul. 23, 2013

(54) ELECTRICAL CIRCUIT BREAKER AND SWITCH POSITION INDICATOR THERETO

(75) Inventor: Achim Stelter, Kassel (DE)

(73) Assignee: Areva Energietechnik GmbH, Frankfurt (DE)

( * ) Notice: Subject to any disclaimer, the term of this patent is extended or adjusted under 35 U.S.C. 154(b) by 309 days.

(21) Appl. No.: 12/926,246

(22) Filed: Nov. 4, 2010

(65) Prior Publication Data

US 2011/0147179 A1 Jun. 23, 2011

(30) Foreign Application Priority Data

Dec. 18, 2009 (EP) ..... 09015686

(51) Int. Cl.
*H01H 9/16* (2006.01)

(52) U.S. Cl.
USPC ..... 200/308; 218/154

(58) Field of Classification Search
USPC ..... 200/308–317; 218/43, 68, 65, 74, 218/78, 84, 118, 122, 123, 134, 139, 140, 218/146, 154, 155; 340/635, 643, 644, 815.63, 340/815.65
See application file for complete search history.

(56) References Cited

U.S. PATENT DOCUMENTS

| | | | | |
|---|---|---|---|---|
| 3,896,282 | A * | 7/1975 | Chabala | 218/62 |
| 4,238,657 | A * | 12/1980 | Opfer et al. | 200/308 |
| 4,439,653 | A * | 3/1984 | Umino et al. | 200/400 |
| 5,663,712 | A | 9/1997 | Kamp | |
| 5,668,360 | A * | 9/1997 | Perret et al. | 218/5 |
| 5,898,151 | A * | 4/1999 | Plat et al. | 218/84 |
| 6,013,888 | A * | 1/2000 | Thuries | 218/14 |
| 7,507,932 | B2 * | 3/2009 | Hunger et al. | 218/78 |
| 7,579,571 | B2 * | 8/2009 | Siebens et al. | 218/120 |
| 7,642,480 | B2 * | 1/2010 | Ozil et al. | 218/14 |
| 8,013,268 | B2 * | 9/2011 | Ozil et al. | 218/155 |
| 2011/0000772 | A1 * | 1/2011 | Hanai et al. | 200/308 |

FOREIGN PATENT DOCUMENTS

| | | |
|---|---|---|
| DE | 197 30 583 | 2/1998 |
| DE | 198 14 397 | 12/1999 |

OTHER PUBLICATIONS

International Search Report.

* cited by examiner

*Primary Examiner* — Michael Friedhofer

(74) *Attorney, Agent, or Firm* — Harness, Dickey & Pierce, P.L.C.

(57) ABSTRACT

An electrical circuit breaker, in particular a high-voltage circuit breaker filled with insulating gas, is described. The circuit breaker is furnished with a first contact, in particular, a contact pin and a second contact, in particular, a tulip contact that are movable in opposite directions. The circuit breaker is furnished with a drive mechanism that is coupled to the second contact. The circuit breaker is furnished with a reversing gear that produces a coupling between the second and the first contact. A first indicator element is provided that is associated with the reversing gear.

19 Claims, 2 Drawing Sheets

ELECTRICAL CIRCUIT BREAKER AND SWITCH POSITION INDICATOR THERETO

PRIORITY STATEMENT

The present application hereby claims priority under 35 U.S.C. §119 on European patent application number EP 09 015 686.0-2214 filed Dec. 18, 2009, the entire contents of which are hereby incorporated herein by reference.

FIELD

The invention relates to an electrical circuit breaker and/or a switch position indicator for a circuit breaker.

BACKGROUND

A circuit breaker is known from DE 197 30 583 B4, for example.

In such an electrical circuit breaker, the drive mechanism of the circuit breaker can have an associated switch position indicator, with the aid of which it is indicated to a user whether the circuit breaker is in its off-position and thus in a nonconductive state, or in its on-position and thus in a conductive state.

The problem of the invention is to improve this switch position indicator.

SUMMARY

At least one embodiment of the invention is directed to an electrical circuit breaker and/or a switch position indicator.

According to at least one embodiment of the invention, an electrical circuit breaker is provided that is furnished with a first contact and a second contact which can be moved in different directions. The circuit breaker is furnished with a drive mechanism that is coupled to the second contact. The circuit breaker is furnished with a reversing gear that produces a coupling between the second and the first contact. A first indicator element is provided that is associated with the reversing gear.

The indicator element according to at least one embodiment of the invention is associated with the reversing gear. Therefore, if a malfunction occurs in the area of the reversing gear, this has an influence on the indication of the indicator element.

This brings the advantage that, if a user wishes to switch the circuit breaker into a desired state or desired switching position and if the indication of the indicator element according to the invention indicates a different state than that which is desired or the desired switching position, the user can infer a malfunction, in particular of the reversing gear of the circuit breaker, solely based on the invented indicator element.

Such a malfunction of the reversing gear in particular cannot be recognized with a circuit breaker according to the prior art, since the switch position indicator in that case is typically associated only with the drive mechanism, but not with the reversing gear.

It is understood that the circuit breaker can be configured in various manners. In particular, the movement of the two contacts can also be configured differently than in the exemplary embodiment explained below. To that extent, the reversing gear can be a coupling between the two contacts in general that is realized mechanically or in some other manner. With the aid of the switch position indicator according to the invention, a malfunction of this coupling of the two contacts in particular can be recognized.

In an advantageous embodiment of the invention, a second indicator element is present, which is coupled to the drive mechanism, wherein the two indicator elements are each provided for indicating an off-position or on-position of the circuit breaker, and wherein a malfunction of the circuit breaker exists if the two indicator elements indicate different states. The off-position represents a nonconductive state, and the on-position a conductive state of the circuit breaker.

In this manner, recognizing a malfunction of the circuit breaker is facilitated for the user.

The reversing gear preferably comprises, among other things, a deflection lever that can be pivoted about a deflection shaft, the first indicator element being associated with the deflection lever. It is expedient in this case if the first indicator element is fixedly connected to the deflection shaft.

It is particularly advantageous if at least a part of the deflection shaft projects outward from the circuit breaker, the first indicator element being fixedly connected to this part of the deflection shaft. In this manner, the production of the circuit breaker can be simplified. In particular, the first indicator element according to at least one embodiment of the invention can be retroactively mounted on existing circuit breakers.

BRIEF DESCRIPTION OF THE DRAWINGS

Additional characteristics, application possibilities and advantages of the invention follow from the description of exemplary embodiments of the invention below, which are shown in the figures of the illustration. All described and/or graphically indicated characteristics, on their own or in any desired combination, constitute the subject matter of the invention, independently of their combination in individual claims and/or the references thereof, and independently of their formulation or representation in the description or in the drawing.

DETAILED DESCRIPTION OF THE EXAMPLE EMBODIMENTS

Figure 1A:
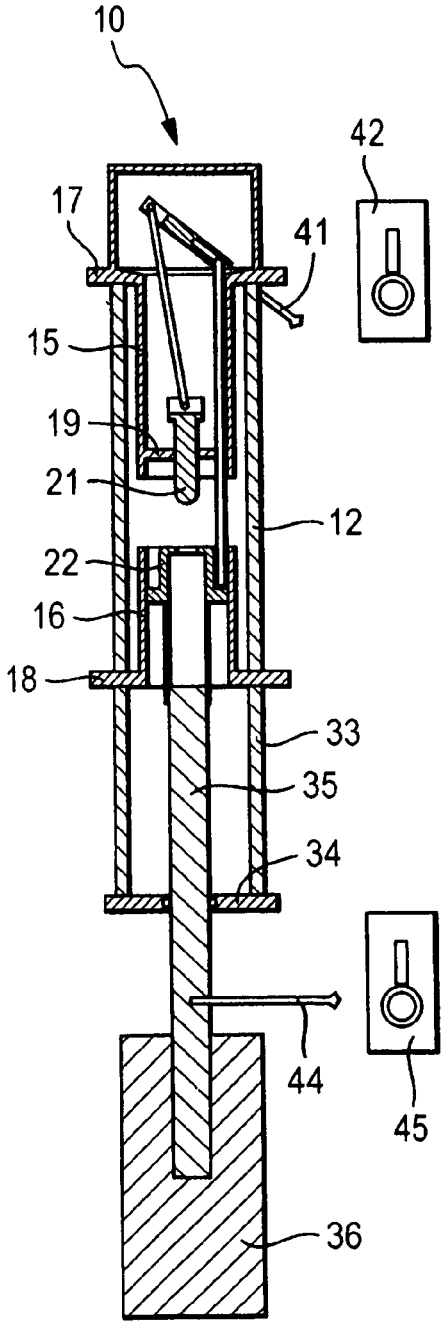
FIGS. 1*a*, 1*b* each show a schematic longitudinal section through an exemplary embodiment of an electrical circuit breaker according to the invention in its off-position and its on-position.
Figure 1B:
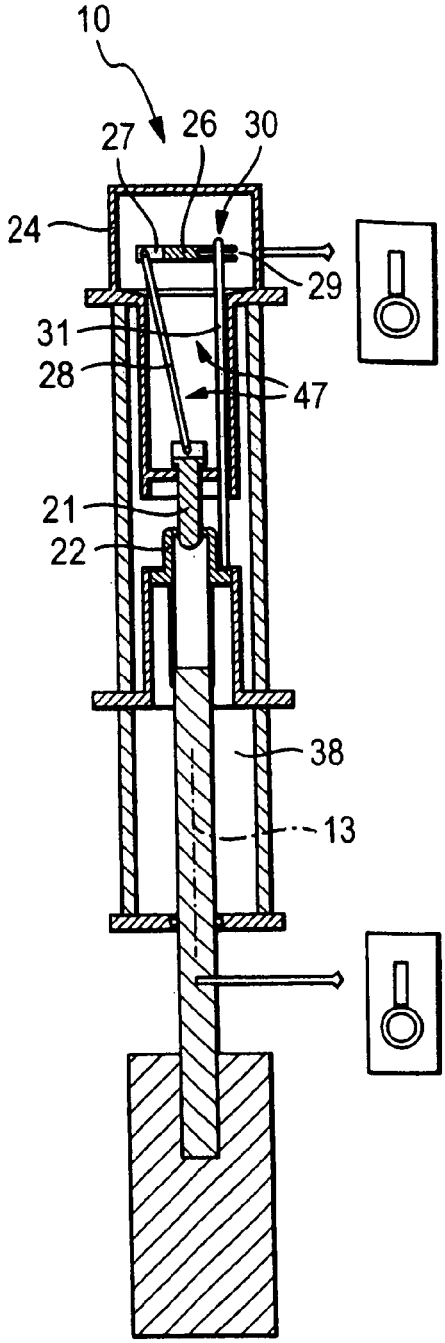
Figure 2:
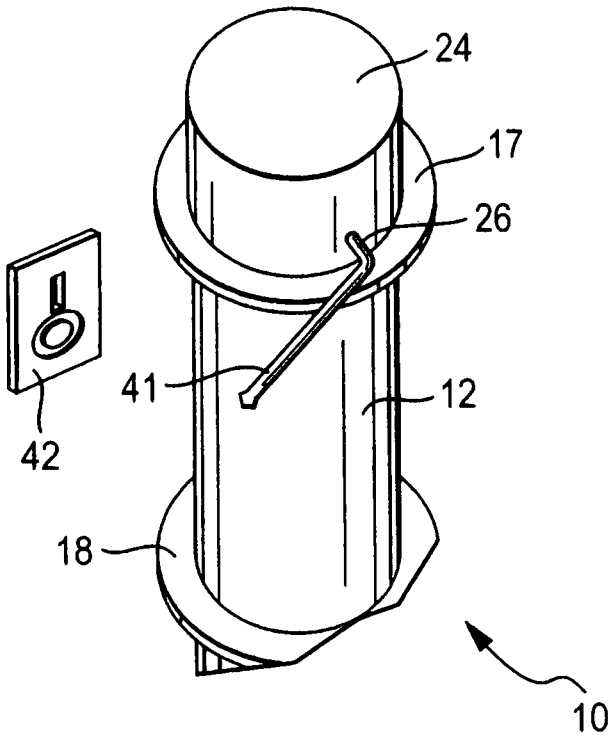
FIG. 2 shows a perspective view of the rear side of the circuit breaker from FIGS. 1*a*, 1*b*.

FIGS. 1*a*, 1*b* and 2 show an individual electrical circuit breaker 10, which is typically a component of a multiphase switching device. The circuit breaker 10 is, in particular, a high-voltage circuit breaker which is typically set up vertically in the outdoors, as shown in FIGS. 1*a*, 1*b*. Of course the circuit breaker 10 can also be installed in an interior space of a switching system.

The circuit breaker 10 shown in FIGS. 1*a*, 1*b*, 2 has a roughly tubular insulator body 12 that defines a longitudinal axis 13. At the upper end and the lower end of the insulator body 12, an upper and lower movable contact carrier 15, 16 is arranged, each being roughly tubular in shape and extending into the insulator body 12 from the bottom or the top, respectively, and each having a respective radially projecting high-voltage connection plate 17, 18 with which it projects outwards from the insulator body 12. The two high-voltage connection plates 17, 18 of the electrically conductive moving contact carriers 15, 16 represent the electrical connection poles of the circuit breaker 10.

The upper movable contact carrier 15 is provided with a bottom 19 containing an opening in which an electrically conductive first contact, specifically a contact pin 21 is guided movably and roughly coaxially with the longitudinal axis 13. Along the inside wall of the lower movable contact carrier 16, an electrically conductive second contact, specifically, a tulip contact 22, is movably guided roughly coaxially with the longitudinal axis 13. The movable contact carrier 15, the bottom 19 and the contact pin 21 belong to a first, upper contact system in the exemplary embodiment shown in FIGS. 1*a*, 1*b*, and are conductively connected to one another. In a corresponding manner, the movable contact carrier 16 and the tulip contact 22 belong to a second, lower contact system in the exemplary embodiment shown in FIGS. 1*a*, 1*b*, and are likewise conductively connected to one another.

An insulator nozzle, extending in a direction towards the contact pin 21 and largely surrounding it, is typically connected to the tulip contact 22. This insulator nozzle is not shown in FIGS. 1*a*, 1*b* for reasons of clarity.

The upper movable contact carrier 15 is connected to a hat-shaped cover 24. A deflection shaft 26 is pivotably seated in the cover 24. The pivot axis of the deflection shaft 26 is oriented roughly perpendicular to the longitudinal axis 13 and lies perpendicular to the drawing plane in FIGS. 1*a*, 1*b*. A part of the deflection shaft 26 projecting outwards from the cover 24 is shown in FIG. 2.

A deflection lever 27 is rotationally fixedly connected to the deflection shaft 26. The deflection lever 27 is oriented roughly perpendicular to the deflection shaft 26. At one free end, the deflection lever 27 is pivotably connected to a connecting rod 28, which is in turn pivotably connected to the contact pin 21. The other free end of the deflection lever 27 contains a longitudinal slot 29 in which a sliding element 30 is movably housed. The sliding element 30 is pivotably connected to a pushrod 31. The pushrod 31 is oriented roughly parallel to the longitudinal axis 13 and runs through an opening in the bottom 19 of the upper movable contact carrier 15 in the direction towards the lower movable contact carrier 16. There the pushrod 31 is connected to the tulip contact 22. The pushrod 31 consists of an insulating material. It is of course also conceivable that only a part of the pushrod 31 consists of an insulating material or that it is constructed to be insulating.

In particular, the pushrod 31 can consist of conductive material and comprise an insulating intermediate element.

It is noted that the pushrod 31 can also be mounted on the above-mentioned insulator nozzle, not shown in FIGS. 1*a*, 1*b*.

Starting from the lower movable contact carrier 16, the insulator body 12 is prolonged downwards with a roughly tubular ground insulator 33. The ground insulator 33 is closed by a cover 34 containing an opening through which a drive rod 35 extends. The drive rod 35 is oriented roughly coaxially with the longitudinal axis 13 and is connected to the tulip contact 22. The drive rod 35 consists of an insulating material or is constructed to be at least partially insulating, and is connected to a mechanical (with spring), electrical, pneumatic or hydraulic drive unit 36.

The insulator body 12, the two high-voltage connection plates 17, 18, the cover 24, the ground insulator 33 and its cover 34 form a gas-tight interior space 38 which is filled with an insulator gas such as SF6. As mentioned, the deflection shaft 26 (see FIG. 2) and the drive rod 35 (see FIGS. 1*a*, 1*b*) project outward from this interior 38.

In the part of the deflection shaft 26 running outside the gas tight interior 38, a first indicator element 41 is fixedly mounted on the deflection shaft 26. The indicator element 41 is located on the rear side of the circuit breaker 10 in FIGS. 1*a*, 1*b* and is therefore not completely visible, whereas the indicator element 41 is completely visible in FIG. 2, which shows the rear side of the circuit breaker 10. In the present exemplary embodiment, the indicator element 41 is constructed like a rod, projects roughly perpendicularly from the deflection shaft 26 and points in the direction of an associated position indicator 42. Here as well, a number of other configurations are of course possible.

It is understood that the first indicator element 41 can also be coupled in a different manner to the deflection shaft 26 and/or to the deflection lever 27 and/or to the connecting rod 28 and/or to the pushrod 31. This coupling can be configured directly or indirectly. In general, the first indicator element 41 is associated with the above-mentioned components of the circuit breaker 10 forming a reversing gear 47, in particular, with the deflection lever 27, and the first indicator element 41 is only fixedly connected to the deflection shaft 26 in the present special embodiment.

In the part of the drive rod 35 running outside the gas-tight interior 38, a second indicator element 44 is fixedly mounted on the drive rod 35. In the present exemplary embodiment, the indicator element 44 is constructed like a rod, projects roughly perpendicularly from the drive rod 35 and points in the direction of an associated position indicator 45.

The two position indicators 42, 45 each have a figure symbol, in particular a "0" for the off-position and a "1" for the on-position. The off-position represents a nonconductive state and the on-position a conductive state.

The circuit breaker 10 is shown in its nonconductive state in FIG. 1*a*. This means that the contact pin 21 and the tulip contact 22 are spaced away from one another and are thus not electrically connected. The two indicator elements 41, 44 point to the icon "0" of the respective associated position indicator 42, 45. The two indicator elements 41, 44 thus indicate the nonconductive state of the circuit breaker 10.

For a transition from the off-position of FIG. 1*a* into the on-position in FIG. 1*b*, the drive rod 35 of the circuit breaker 10 is moved by the drive mechanism 36 upwards, i.e., in the direction towards the insulator body 12. This has the result that the tulip contact 22 likewise moves upwards, i.e., in the direction towards the contact pin 21. At the same time, the pushrod 31 is pushed by the tulip contact 22 upwards, which has the result that the deflection lever 27 rotates about the pivot axis formed by the deflection shaft 26. In this movement, the sliding element 30 is displaced in the longitudinal slot 29 of the deflection lever 27. Due to the rotation of the deflection lever 27, the pushrod 28 and therefore the contact pin 21 as well, move downward, i.e., in the direction towards the tulip contact 22.

Due to the above-explained opposite movements of the tulip contact 22 on the one hand and the contact pin 21 on the other, the two contacts approach one another and finally come into engagement. The latter-mentioned state is shown in FIG. 1*b*, in which a conductive connection between the contact pin 21 and the tulip contact 22 is present due to the engagement. The two indicator elements 41, 44 point to the icon "1" of the respective associated position indicator 42, 45. The two indicator elements 41, 44 thus indicate the conductive state of the circuit breaker 10.

For a transition from the on-position of FIG. 1*b* into the off-position of FIG. 1*a*, the drive rod 35 of the circuit breaker 10 is moved downwards by the drive mechanism 36, i.e., in the direction towards the drive mechanism 36. The above explained movements of the components of the circuit breaker 10 then take place in a correspondingly opposite manner. If the contact pin 21 and the tulip contact 22 are again in the nonconductive state of FIG. 1*a*, the two indicator elements 41, 44 again point to the icon "0" of the respective associated position indicator 42, 45. The two indicator elements 41, 44 thus again indicate the nonconductive state of the circuit breaker 10.

The off-position of the circuit breaker 10 according to FIG. 1*a* is present only if the contact pin 21 is drawn almost completely upwards and the tulip contact 22 almost completely downwards. Only if this position is achieved, do the two indicator elements 41, 44 according to FIG. 1*a* indicate the icon "0" of the respective associated position indicators 42, 45.

Those components that produce the mechanical coupling between the tulip contact 22 and the contact pin 21, i.e., the pushrod 31, the deflection lever 27, the deflection shaft 26 and the connection rod 28, were already referred to as reversing gear 47.

If there is a malfunction of one of the above-mentioned components of the reversing gear 47, it is possible that the nonconductive state of FIG. 1*a* cannot be achieved at all, or at least not completely. For example, if the pushrod 31 is broken, then the tulip contact 22 moves upward, but the contact pin 21 is not moved due to the nonfunctional pushrod 31, so that the contact pin 21 remains in its upper position. The same is true, for example, if the deflection lever 27 is tilted and/or the deflection shaft 26 is jammed or broken and/or if the pin 21 is jammed or tilted.

Such a fault becomes identifiable because only the second indicator element 44 connected to the drive rod 35 points to the icon "0" of the associated position indicator 45 in the off-position, whereas the first indicator element 41 connected to the deflection lever 27 points to the icon "1" of the associated position indicator 44.

Thus if the two indicator elements 41, 44 point to different icons of the respective associated position indicators 42, 45, a malfunction of the circuit breaker 10 can be inferred. In particular, it can be inferred that the nonconductive state of the circuit breaker 10 in accordance with FIG. 1*a* has not been achieved at all, or at least not completely. This is equivalent to the statement that the dielectric strength specified or required for the nonconductive state of the circuit breaker 10 cannot be guaranteed.

If the distance between the two contacts 21, 22 falls below a defined distance, i.e. the distance is not sufficient to guarantee a specified dielectric strength, this is also indicated by the position indicators 42, 45 in that at least one of the two indicator elements 41, 44 is in an intermediate position between the icons "0" and "1".

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

The invention claimed is:

1. An electrical circuit breaker, comprising:

a first contact;

a second contact, the first contact and the second contact being movable in opposite directions;

a drive mechanism coupled to the second contact;

a reversing gear coupling the second contact and the first contact; and a first indicator element mechanically coupled to the reversing gear.

2. The electrical circuit breaker according to claim 1, wherein the first contact and the second contact are movable along a longitudinal axis of the electrical circuit breaker.

3. The electrical circuit breaker according to claim 2, wherein the reversing gear comprises a deflection lever pivotable about a deflection shaft, and wherein the first indicator element is associated with the deflection lever.

4. The electrical circuit breaker according to claim 1, further comprising:

a second indicator element coupled to the drive mechanism, wherein the first indicator element and the second indicator element are each configured to indicate at least one of an off-position and an on-position of the electrical circuit breaker, and wherein a malfunction of the electrical circuit breaker exists if the first indicator element and second indicator element indicate different states.

5. The electrical circuit breaker according to claim 4, wherein the first indicator element is connected to a drive rod connecting the drive mechanism and the second contact.

6. The electrical circuit breaker according to claim 4, wherein the reversing gear comprises a deflection lever pivotable about a deflection shaft, and wherein the first indicator element is associated with the deflection lever.

7. The electrical circuit breaker according to claim 1, wherein the reversing gear comprises a deflection lever pivotable about a deflection shaft, and wherein the first indicator element is associated with the deflection lever.

8. The electrical circuit breaker according to claim 7, wherein the first indicator element is fixedly connected to the deflection shaft.

9. The electrical circuit breaker according to claim 8, wherein at least a part of the deflection shaft projects outward from the electrical circuit breaker, and wherein the first indicator element is fixedly connected to the part of the deflection shaft.

10. The electrical circuit breaker according to claim 9, wherein the reversing gear comprises a connecting rod and a pushrod, each of the connecting rod and the pushrod being coupled to the deflection lever and to at least one of the first contact and the second contact.

11. The electrical circuit breaker according to claim 7, wherein at least a part of the deflection shaft projects outward from the electrical circuit breaker, and wherein the first indicator element is fixedly connected to the part of the deflection shaft.

12. The electrical circuit breaker according to claim 7, wherein the reversing gear comprises a connecting rod and a pushrod, each of the connecting rod and the pushrod being coupled to the deflection lever and to at least one of the first contact and the second contact.

13. The electrical circuit breaker of claim 1, wherein the electrical circuit breaker is a high-voltage electrical circuit breaker filled with an insulating gas.

14. The electrical circuit breaker of claim 1, wherein the first contact is a contact pin and the second contact is a tulip contact.

15. A switch position indicator for an electrical circuit breaker, the electrical circuit breaker including a first contact and a second contact movable in opposite directions, and including a drive mechanism coupled to the second contact, and a reversing gear configured to produce a mechanical coupling between the second contact and the first contact, the switch position indicator comprising:

a first indicator element mechanically coupled to the reversing gear.

16. The switch position indicator according claim 15, wherein the reversing gear comprises a deflection lever pivotable about a deflection shaft, and wherein the first indicator element is associated with the deflection lever.

17. The switch position indicator according to claim 16, wherein the first indicator element is fixedly connected to the deflection shaft.

18. The switch position indicator according to claim 17, wherein at least a part of the deflection shaft projects outward from the electrical circuit breaker, and wherein the first indicator element is fixedly connected to the part of the deflection shaft.

19. The switch position indicator according to claim 16, wherein at least a part of the deflection shaft projects outward from the electrical circuit breaker, and wherein the first indicator element is fixedly connected to the part of the deflection shaft.

* * * * *